US011959177B2

(12) United States Patent
Kasai et al.

(10) Patent No.: US 11,959,177 B2
(45) Date of Patent: *Apr. 16, 2024

(54) STEEL FOR NITROCARBURIZING AND NITROCARBURIZED COMPONENT, AND METHODS OF PRODUCING SAME

(71) Applicant: JFE STEEL CORPORATION, Tokyo (JP)

(72) Inventors: Masayuki Kasai, Tokyo (JP); Takashi Iwamoto, Tokyo (JP); Kunikazu Tomita, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 668 days.

This patent is subject to a terminal disclaimer.

(21) Appl. No.: 17/107,955

(22) Filed: Dec. 1, 2020

(65) Prior Publication Data

US 2021/0102283 A1 Apr. 8, 2021

Related U.S. Application Data

(63) Continuation of application No. 15/559,950, filed as application No. PCT/JP2016/001721 on Mar. 24, 2016, now abandoned.

(30) Foreign Application Priority Data

Mar. 24, 2015 (JP) ..... 2015-061400

(51) Int. Cl.

| | |
|---|---|
| ***C23C 8/32*** | (2006.01) |
| ***C21D 1/06*** | (2006.01) |
| ***C21D 1/74*** | (2006.01) |
| ***C21D 6/00*** | (2006.01) |
| ***C21D 8/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/38*** | (2006.01) |
| ***C22C 38/42*** | (2006.01) |
| ***C22C 38/44*** | (2006.01) |

(Continued)

(52) U.S. Cl.

CPC ..... *C23C 8/32* (2013.01); *C21D 1/06* (2013.01); *C21D 1/74* (2013.01); *C21D 6/004* (2013.01); *C21D 6/005* (2013.01); *C21D 6/008* (2013.01); *C21D 8/005* (2013.01); *C21D 8/0226* (2013.01); *C21D 8/0263* (2013.01); *C22C 38/001* (2013.01); *C22C 38/002* (2013.01); *C22C 38/008* (2013.01); *C22C 38/02* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C22C 38/60* (2013.01); *C23C 8/26* (2013.01); *C21D 1/20* (2013.01); *C21D 7/13* (2013.01); *C21D 2211/002* (2013.01); *C21D 2211/004* (2013.01)

(58) Field of Classification Search

CPC ..... C23C 8/32; C22C 38/001; C22C 38/002; C22C 38/008; C22C 38/02; C22C 38/06; C22C 38/20; C22C 38/22; C22C 38/24; C22C 38/26; C22C 38/28; C22C 38/30; C22C 38/32; C22C 38/38; C22C 38/42; C22C 38/44; C22C 38/46; C22C 38/48; C22C 38/54; C22C 38/58; C22C 38/60; C21D 2211/002; C21D 2211/004

USPC ..... 428/676

See application file for complete search history.

(56) References Cited

U.S. PATENT DOCUMENTS 7,815,750 B2 10/2010 Okonogi et al.
8,876,988 B2 11/2014 Chida et al.

(Continued)

FOREIGN PATENT DOCUMENTS

CN 103003459 A 3/2013
CN 104114733 A 10/2014

(Continued)

OTHER PUBLICATIONS

Jun. 21, 2016, International Search Report issued in the International Patent Application No. PCT/JP2016/001721.

(Continued)

*Primary Examiner* — Katherine A Christy
(74) *Attorney, Agent, or Firm* — KENJA IP LAW PC

(57) ABSTRACT

A component comprising a core part and a surface layer is provided. The core part contains C: 0.01%≤ and <0.20%, Si: ≤1.0%, Mn: 1.5%≤ and ≤3.0%, P: 0.02% or less, S: ≤0.06%, Cr: 0.30%≤ and ≤3.0%, Mo: 0.005%≤ and ≤0.40%, V: 0.02%≤ and ≤0.5%, Nb: 0.003%≤ and ≤0.20%, Al: 0.010%≤ and ≤2.0%, Ti: 0.005%< and <0.025%, N: ≤0.0200%, Sb: 0.0005%≤ and ≤0.02%, and the balance consisting of Fe and incidental impurities; and a steel microstructure that contains bainite phase in an area ratio of more than 50%. The surface layer has high nitrogen and carbon contents relative to the chemical composition of the core part.

3 Claims, 1 Drawing Sheet

(51) Int. Cl.

| | |
|---|---|
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C22C 38/60*** | (2006.01) |
| ***C23C 8/26*** | (2006.01) |
| *C21D 1/20* | (2006.01) |
| *C21D 7/13* | (2006.01) |

(56) References Cited

U.S. PATENT DOCUMENTS

| | | | |
|---|---|---|---|
| 2013/0087250 | A1 | 4/2013 | Chida et al. |
| 2014/0283954 | A1 | 9/2014 | Burris et al. |
| 2015/0020926 | A1 | 1/2015 | Iwamoto et al. |
| 2015/0027591 | A1 | 1/2015 | Gyotoku et al. |
| 2015/0159261 | A1 | 6/2015 | Omori et al. |
| 2016/0032431 | A1 | 2/2016 | Kobayashi et al. |

FOREIGN PATENT DOCUMENTS

| | | | |
|---|---|---|---|
| JP | H0559488 | A | 3/1993 |
| JP | H07102343 | A | 4/1995 |
| JP | 3094856 | B2 | 10/2000 |
| JP | 2000282175 | A | 10/2000 |
| JP | 2002069572 | A | 3/2002 |
| JP | 2006193827 | A | 7/2006 |
| JP | 2007146232 | A | 6/2007 |
| JP | 2010163671 | A | 7/2010 |
| JP | 2011032537 | A | 2/2011 |
| JP | 2013166997 | A | 8/2013 |
| JP | 5567747 | B2 | 8/2014 |
| JP | 2014201764 | A | 10/2014 |
| WO | 2012067181 | A1 | 5/2012 |
| WO | 2013121794 | A1 | 8/2013 |
| WO | 2013140869 | A1 | 9/2013 |
| WO | 2014017074 | A1 | 1/2014 |

OTHER PUBLICATIONS

Jun. 22, 2018, Office Action issued by the State Intellectual Property Office in the corresponding Chinese Patent Application No. 201680016466.8 with English language Search Report.

Machine Translation of JP 2000-282175 via EPO website.

Nov. 23, 2017, Extended European Search Report issued by the European Patent Office in the corresponding European Patent Application No. 16768070.1.

ASM International, Materials Park, Ohio, ASM Handbook vol. 1: Hardenability of carbon and low-alloy steels, pp. 464-483, Mar. 1990.

ASM International, Materials Park, Ohio, ASM Handbook vol. 1: Hardenability of carbon and low-alloy steels, pp. 144-147, Mar. 1990.

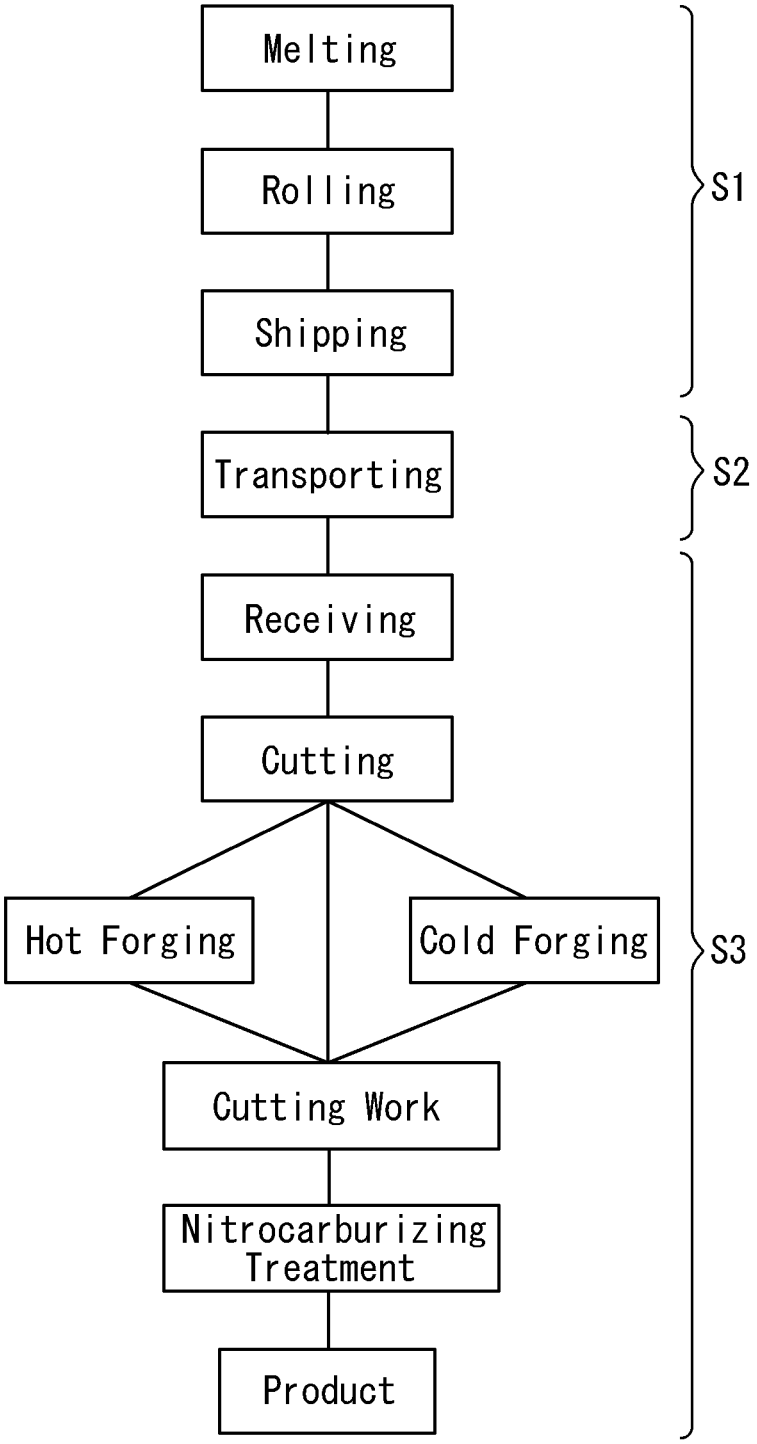
Melting
Rolling
Shipping
S1
Transporting
S2
Receiving
Cutting
Hot Forging
Cold Forging
S3
Cutting Work
Nitrocarburizing Treatment
Product

STEEL FOR NITROCARBURIZING AND NITROCARBURIZED COMPONENT, AND METHODS OF PRODUCING SAME

CROSS-REFERENCE TO RELATED APPLICATION

This application is a continuation of U.S. application Ser. No. 15/559,950 filed Sep. 20, 2017, which is a National Stage Application of PCT/JP2016/001721 filed Mar. 24, 2016, which claims priority based on Japanese Patent Application No. 2015-061400 filed Mar. 24, 2015. The disclosures of the prior applications are hereby incorporated by reference herein in their entirety.

TECHNICAL FIELD

The present disclosure relates to steel for nitrocarburizing and component obtained from the steel for nitrocarburizing, and methods of producing these. The components according to the disclosure exhibit hot forgeability and excellent fatigue properties after nitrocarburizing treatment and are suitable for use as components for automobiles and construction machinery.

BACKGROUND

Since excellent fatigue properties are desired for machine structural components, such as automobile gears, surface hardening is generally performed. Examples of well-known surface hardening treatment include carburizing treatment, induction quench hardening, and nitriding treatment.

Among these, in carburizing treatment, C is immersed and diffused in high-temperature austenite region and a deep hardening depth is obtained. Therefore, carburizing treatment is effective in improving fatigue strength. However, since heat treatment distortion occurs by carburizing treatment, it was difficult to apply such treatment to components that require severe dimensional accuracy from the perspective of noise or the like.

Further, in induction quench hardening, since quenching is performed on a surface layer part by high frequency induction heating, heat treatment distortion is generated, and therefore results in poor dimensional accuracy as in the case with carburizing treatment.

On the other hand, in nitriding treatment, surface hardness is increased by immersing and diffusing nitrogen in a relatively low temperature range at or below the $Ac_1$ transformation temperature, and therefore there is no possibility of heat treatment distortion such as mentioned above. However, there were problems that the treatment requires a long time of 50 hours to 100 hours, and then it is necessary to remove brittle compound layers on the surface layer after performing the treatment.

Therefore, nitrocarburizing treatment in which treatment is performed at a treatment temperature almost equal to nitriding treatment temperature and in a shorter treatment time was developed, and in recent years, such treatment has been widely used for machine structural components and the like. During this nitrocarburizing treatment, N and C are simultaneously infiltrate and diffused in a temperature range of 500° C. to 600° C. to harden the surface, and the treatment time can be made half of what is required for conventional nitriding treatment.

However, whereas the above-mentioned carburizing treatment enables to increase the core hardness by quench hardening, nitrocarburizing treatment does not increase core hardness since the treatment is performed at a temperature at or below the transformation point of steel. Therefore, fatigue strength of the nitrocarburized material is inferior compared to the carburized material.

In order to improve the fatigue strength of the nitrocarburized material, quenching and tempering are usually performed before nitrocarburizing to increase the core hardness. However, the resulting fatigue properties cannot be considered sufficient. Furthermore, this approach increases production costs and reduces mechanical workability.

To address these issues, JPH559488A (PTL 1) proposes a steel for nitrocarburizing which can exhibit high bending fatigue strength after subjection to nitrocarburizing treatment by adding Ni, Al, Cr, Ti, and the like to the steel. Specifically, this steel is subjected to nitrocarburizing treatment, whereby the core part is age hardened with Ni—Al- or Ni—Ti-based intermetallic compounds or Cu compounds, while in the surface layer part, for example, nitrides or carbides of Cr, Al, Ti, and the like are caused to precipitate and harden in the nitride layer to improve bending fatigue strength.

JP200269572A (PTL 2) proposes a steel for nitrocarburizing which provides excellent bending fatigue properties after subjection to nitrocarburizing treatment by subjecting a steel containing 0.5% to 2% of Cu to extend forging by hot forging, and then air cooling the steel so as to have a microstructure mainly composed of ferrite with solute Cu dissolved therein, and then causing precipitation hardening of Cu during nitrocarburizing treatment at 580° C. for 120 minutes and precipitation hardening of carbonitrides of Ti, V and Nb.

JP2010163671A (PTL 3) proposes a steel for nitrocarburizing obtained by dispersing Ti—Mo carbide, and further dispersing carbides containing one or more of Nb, V, and W.

JP2013166997A (PTL 4) proposes a steel material for nitrocarburizing that exhibits excellent fatigue strength by providing a steel containing V and Nb with a microstructure in which bainite is dominantly present prior to nitriding to suppress precipitation of V and Nb carbonitrides, and these carbonitrides are caused to precipitate upon nitriding to increase core hardness.

CITATION LIST

Patent Literature

PTL 1: JPH559488A
PTL 2: JP200269572A
PTL 3: JP2010163671A
PTL 4: JP2013166997A
PTL 5: JP5567747B
PTL 6: JP201132537A

SUMMARY

Technical Problem

However, in the nitrocarburized steel described in PTL 1, although bending fatigue strength is improved by precipitation hardening of Ni—Al- or Ni—Ti-based intermetallic compounds, Cu, and the like, workability cannot be said to be sufficiently secured, and a high Ni content leads to the problem of increased production costs.

The steel for nitrocarburizing in PTL 2 requires Cu, Ti, V, and Nb to be added to the steel in relatively large amounts, and has the problem of high production costs.

Further, the steel for nitrocarburizing in PTL 3 contains Ti and Mo in relatively large amounts, and also has the problem of high cost.

In the case of the steel materials for nitriding in PTLs 4 and 5, to ensure machinability by cutting, the increase of bainite hardness is suppressed by reducing C content. Hardenability decreases as the C content decreases, which makes it difficult to form a bainitic microstructure. To compensate for this, Mn, Cr, and Mo, which are effective for improving hardenability, are added to the steel to promote the formation of a bainitic microstructure. In the case of a rolled material being produced by continuous casting, however, surface defects, called "continuous cast cracks", easily form on the surface of the cast steel, leading to the problem of reduced manufacturability.

In addition, the steel for nitriding in JP201132537A (PTL 6) has a problem that surface cracks are liable to occur during continuous casting, resulting in poor manufacturability.

It could thus be helpful to provide a steel for nitrocarburizing whose mechanical workability before nitrocarburizing treatment is guaranteed by ensuring fatigue resistance without causing the steel to harden before subjection to nitrocarburizing treatment, and a method of producing the same.

It could also be helpful to provide a nitrocarburized component whose fatigue properties can be improved by increasing the surface hardness through nitrocarburizing treatment after machining.

Solution to Problem

In order to solve the above problems, we intensely investigated the influence of the chemical composition and microstructure of steel.

As a result, we discovered that by arranging a steel to have a chemical composition properly that contains V and Nb in appropriate amounts, Sb in small amounts, and a steel microstructure that contains bainite phase in an area ratio of more than 50%, the resulting steel may have excellent mechanical workability, and that after the steel being subjected to nitrocarburizing treatment, fine precipitates containing V and Nb at their cores are caused to dispersedly precipitate to increase core hardness, and excellent fatigue properties can be obtained.

The present disclosure was completed through additional examination based on the above discoveries.

Specifically, the primary features of this disclosure are as described below.

1. A steel for nitrocarburizing comprising: a chemical composition that contains (consists of), in mass %, C: 0.01% or more and less than 0.20%, Si: 1.0% or less, Mn: 1.5% or more and 3.0% or less, P: 0.02% or less, S: 0.06% or less, Cr: 0.30% or more and 3.0% or less, Mo: 0.005% or more and 0.40% or less, V: 0.02% or more and 0.5% or less, Nb: 0.003% or more and 0.20% or less, Al: 0.010% or more and 2.0% or less, Ti: more than 0.005% and less than 0.025%, N: 0.0200% or less, Sb: 0.0005% or more and 0.02% or less, the balance consisting of Fe and incidental impurities, with the chemical composition satisfying either one of the following relations:

in a case where the C content is 0.01% or more and 0.10% or less, $$(S/32)/(Ti/48)+(N/14)/(Ti/48)\leq 13.0, \text{ and}$$

in a case where the C content is more than 0.10% and less than 0.20%, $$2(S/32)/(Ti/48)+3(N/14)/(Ti/48)\leq 35.0; \text{ and}$$

a steel microstructure that contains bainite phase in an area ratio of more than 50%.

2. The steel for nitrocarburizing according to 1., wherein the steel composition further contains, in mass %, one or more selected from the group consisting of B: 0.0100% or less, Cu: 0.3% or less, and Ni: 0.3% or less.

3. The steel for nitrocarburizing according to 1. or 2., wherein the steel composition further contains, in mass %, one or more selected from the group consisting of W: 0.3% or less, Co: 0.3% or less, Hf: 0.2% or less, and Zr: 0.2% or less.

4. The steel for nitrocarburizing according to 1., 2., or 3., wherein the steel composition further contains, in mass %, one or more selected from the group consisting of Pb: 0.2% or less, Bi: 0.2% or less, Zn: 0.2% or less, and Sn: 0.2% or less.

5. A component comprising: a core part comprising the chemical composition and the steel microstructure as recited in any one of 1. to 4.; and a surface layer part comprising a chemical composition with high nitrogen and carbon contents relative to the chemical composition of the core part.

6. The component according to 5., wherein precipitates containing V and Nb are dispersed in the bainite phase.

7. A method of producing a steel for nitrocarburizing, comprising: subjecting a steel to hot working with a heating temperature of 950° C. or higher and a finishing temperature of 800° C. or higher, the steel comprising a chemical composition that contains (consists of), in mass %, C: 0.01% or more and less than 0.20%, Si: 1.0% or less, Mn: 1.5% or more and 3.0% or less, P: 0.02% or less, S: 0.06% or less, Cr: 0.30% or more and 3.0% or less, Mo: 0.005% or more and 0.40% or less, V: 0.02% or more and 0.5% or less, Nb: 0.003% or more and 0.20% or less, Al: 0.010% or more and 2.0% or less, Ti: more than 0.005% and less than 0.025%, N: 0.0200% or less, Sb: 0.0005% or more and 0.02% or less, and the balance consisting of Fe and incidental impurities, with the chemical composition satisfying either one of the following relations:

in a case where the C content is 0.01% or more and 0.10% or less, $$(S/32)/(Ti/48)+(N/14)/(Ti/48)\leq 13.0, \text{ and}$$

in a case where the C content is more than 0.10% and less than 0.20%, $$2(S/32)/(Ti/48)+3(N/14)/(Ti/48)\leq 35.0; \text{ and}$$

then cooling the steel at a cooling rate of higher than 0.4° C./s at least in a temperature range of 700° C. to 550° C.

8. The method of producing a steel for nitrocarburizing according to 7., wherein the steel composition further contains, in mass %, one or more selected from the group consisting of B: 0.0100% or less, Cu: 0.3% or less, and Ni: 0.3% or less.

9. The method of producing a steel for nitrocarburizing according to 7. or 8., wherein the steel composition further contains, in mass %, one or more selected from the group consisting of W: 0.3% or less, Co: 0.3% or less, Hf: 0.2% or less, and Zr: 0.2% or less.

10. The method of producing a steel for nitrocarburizing according to 7., 8., or 9., wherein the steel composition further contains, in mass %, one or more selected from the group consisting of Pb: 0.2% or less, Bi: 0.2% or less, Zn: 0.2% or less, and Sn: 0.2% or less.

11. A method of producing a component, comprising: processing the steel for nitrocarburizing obtainable by the method as recited in any one of 7. to 10. into a desired shape;

and then subjecting the steel for nitrocarburizing to nitrocarburizing treatment at 550° C. to 700° C. for 10 minutes or more.

Advantageous Effect

The present disclosure enables producing a steel for nitrocarburizing that is excellent in mechanical workability with an inexpensive chemical composition. By subjecting the steel for nitrocarburizing to nitrocarburizing treatment, it is possible to obtain a component having fatigue properties comparable to or better than, for example, JIS SCr420 steel subjected to carburizing treatment. Therefore, the component disclosed herein is very useful when applied to mechanical structural components such as automotive parts.

BRIEF DESCRIPTION OF THE DRAWING

FIGURE schematically illustrates the steps carried out to produce a nitrocarburized component.

DETAILED DESCRIPTION

The following describes the present disclosure in detail.

Firstly, reasons for limiting the chemical composition to the aforementioned ranges in the disclosure will be described. The % representations below indicating the chemical composition are in mass % unless stated otherwise.

C: 0.01% or More and Less than 0.20%

C is added for the purpose of bainite phase formation and for securing strength. However, if the C content is less than 0.01%, it is not possible to obtain a sufficient amount of bainite phase and the amount of V and Nb precipitates formed after nitrocarburizing treatment is insufficient, making it difficult to guarantee sufficient strength. Therefore, the C content is set to 0.01% or more. On the other hand, if the C content is 0.20% or more, the formed bainite phase increases in hardness, thereby causing mechanical workability and fatigue properties to deteriorate. Therefore, the C content is set to less than 0.20%. More preferably, the C content is 0.04% or more and 0.18% or less.

Si: 1.0% or Less

Si is added for its usefulness for deoxidation and bainite phase formation purposes. If the Si content is more than 1.0%, machinability by cutting and cold workability deteriorate due to solid solution hardening of the ferrite and bainite phases. Therefore, the Si content is set to 1.0% or less. The Si content is preferably 0.8% or less, and more preferably 0.7% or less. For Si to effectively contribute to deoxidation, it is preferable to set the Si content to 0.01% or more.

Mn: 1.5% or More and 3.0% or Less

Mn is added for its usefulness for bainite phase formation and strength enhancement purposes. However, if the Mn content is less than 1.5%, less bainite phase forms, and V and Nb precipitates are caused to form before nitrocarburizing treatment, resulting in increased hardness before nitrocarburizing. Additionally, such a low Mn content decreases the absolute amount of V and Nb precipitates remaining after nitrocarburizing treatment, and ends up lowering the hardness after nitrocarburizing, making it difficult to guarantee sufficient strength. Therefore, the Mn content is set to 1.5% or more. If it exceeds 3.0%, however, continuous casting cracks are more likely to occur, causing machinability by cutting and cold workability to deteriorate. Therefore, the Mn content is set to 3.0% or less. The Mn content is preferably in a range of 1.5% to 2.5%.

P: 0.02% or Less

P segregates at austenite grain boundaries, and lowers grain boundary strength, thereby making continuous casting cracks more likely to occur. This also lowers strength and toughness. Therefore, the P content is desirably kept as small as possible, yet a content of up to 0.02% is tolerable. As setting the content of P to be less than 0.001% requires a high cost, it suffices in industrial terms to reduce the P content to 0.001%.

S: 0.06% or Less

S is a useful element that forms MnS in the steel to improve machinability by cutting. S content exceeding 0.06%, however, causes deterioration of toughness. Therefore, the S content is set to 0.06% or less. Further, S content exceeding 0.06% makes continuous casting cracks more likely to occur. Therefore, the S content is set to 0.04% or less.

For S to achieve an effect of improving machinability by cutting, the S content is preferably set to 0.002% or more.

Cr: 0.30% or More and 3.0% or Less

Cr is added for its usefulness for the purpose of bainite phase formation. Cr also has an effect of forming nitrides through nitrocarburizing and improving surface hardness. However, if the Cr content is less than 0.30%, less bainite phase forms, and V and Nb precipitates are caused to form before nitrocarburizing treatment, resulting in increased hardness before nitrocarburizing. Such a low Cr content also decreases the absolute amount of V and Nb precipitates remaining after nitrocarburizing treatment, and ends up lowering the hardness after nitrocarburizing, making it difficult to guarantee sufficient strength. Therefore, the Cr content is set to 0.30% or more. On the other hand, Cr content exceeding 3.0% lowers hot ductility, and causes hardening to deteriorate machinability by cutting. Therefore, the Cr content is set to 3.0% or less. The Cr content is preferably 0.5% or more and 2.0% or less, and more preferably 0.5% or more and 1.5% or less.

Mo: 0.005% or More and 0.40% or Less

Mo increases hardenability and facilitates bainite phase formation. Consequently, Mo has an effect of causing formation of fine V and Nb precipitates and increasing the strength of the nitrocarburized material. Therefore, Mo is one of the important elements for the present disclosure. Mo is also effective in bainite phase formation. To obtain the strength increasing effect, the Mo content is set to 0.005% or more. On the other hand, Mo content exceeding 0.40% lowers hot ductility and makes the cast steel more prone to continuous casting cracks, and results in a rise in component cost as Mo is an expensive element. Therefore, the Mo content is set in a range of 0.005% to 0.40%. The Mo content is preferably in a range of 0.015% to 0.3%, and more preferably in a range of 0.04% to less than 0.2%.

V: 0.02% or More and 0.5% or Less

V is an important element that forms fine precipitates with Nb due to the temperature rise during nitrocarburizing to thereby increase core hardness and improve strength. To obtain this effect, the V content is 0.02% or more. On the other hand, if the V content exceeds 0.5%, precipitates become coarser, the strength increasing effect is insufficient, and cracking is promoted during continuous casting. Therefore, the V content is 0.5% or less. The V content is preferably in a range of 0.03% to 0.3%, and more preferably in a range of 0.03% to 0.25%.

Nb: 0.003% or More and 0.20% or Less

Nb forms fine precipitates with V due to the temperature rise during nitrocarburizing and increases core hardness, and is thus very effective in increasing fatigue strength. To obtain this effect, the Nb content is set to 0.003% or more. On the other hand, if the Nb content exceeds 0.20%, precipitates become coarser, the strength increasing effect is insufficient, and cracking is promoted during continuous casting. Therefore, the Nb content is set to 0.20% or less. The Nb content is preferably in a range of 0.02% to 0.18%.

Al: 0.010% or More and 2.0% or Less

Al is a useful element for improving surface hardness and effective hardened case depth after nitrocarburizing treatment, and thus is intentionally added. Al is also a useful element for inhibiting the growth of austenite grains during hot forging to yield a finer microstructure and increased toughness. From this perspective, the Al content is set to 0.010% or more. However, adding Al beyond 2.0% does not increase this effect, but instead promotes cracking during continuous casting and results in a rise in component cost, which is disadvantageous. Therefore, the Al content is set to 2.0% or less. Preferably, the Al content is more than 0.020% and no more than 1.5%. More preferably, the Al content is more than 0.020% and no more than 1.2%.

Ti: More than 0.005% and Less than 0.025%

Ti is a useful element for preventing the occurrence of cooling cracks during continuous casting and surface cracks during bending/bend restoration when using a bending continuous casting machine, and is intentionally added in a range exceeding 0.005%. If the Ti content is 0.025% or more, however, coarse TiN is generated and fatigue strength decreases. Therefore, the Ti content is set to less than 0.025%. The Ti content is preferably more than 0.012% and no more than 0.023%, and more preferably in a range of 0.015% to 0.022%.

N: 0.0200% or Less

N is a useful element for forming carbonitrides in the steel and improving the strength of the nitrocarburized material, and is preferably added in an amount of 0.0020% or more. If the N content exceeds 0.0200%, however, the resulting carbonitrides coarsen and the toughness of the steel material decreases. In addition, the cast steel suffers surface cracks, resulting in degradation of cast slab quality. Therefore, the N content is set to 0.0200% or less. The N content is preferably 0.0180% or less.

Sb: 0.0005% or More and 0.02% or Less

Sb has an effect of suppressing grain boundary oxidation and surface cracking during casting, hot rolling, and hot forging, and improving the surface quality of the product. This effect is inadequate when the Sb content is below 0.0005%. On the other hand, adding Sb beyond 0.02% does not increase this effect, but instead results in a rise in component cost and causes Sb to segregate at grain boundaries or otherwise, causing degradation in the toughness of the base steel. Therefore, when added, the Sb content is set to 0.0005% or more and 0.02% or less. The Sb content is preferably 0.0010% or more and 0.01% or less.

Further, in the present disclosure, it is necessary to satisfy the following formula in accordance with the C content:

in a case where the C content is 0.01% or more and 0.10% or less, $$(S/32)/(Ti/48)+(N/14)/(Ti/48)\leq 13.0, \text{ or}$$

in a case where the C content is more than 0.10% and less than 0.20%

$$2(S/32)/(Ti/48)+3(N/14)/(Ti/48)\leq 35.0.$$

We investigated the cause of cracking in the steel during continuous casting, and found that precipitation of coarse MnS to ferrite formed at grain boundaries during continuous casting is responsible for causing cracking. We therefore studied how to suppress the precipitation of MnS to ferrite at grain boundaries, and revealed that the precipitation of MnS is closely related to the contents of C, Ti, S, and N in the steel and that cracking during continuous casting can be suppressed by adjusting the contents of these elements to suppress the precipitation of MnS to ferrite at grain boundaries. In other words, for C, Ti, S, and N, by setting the parameters within the above ranges, it is possible to cause S to precipitate as Ti carbosulfides to suppress precipitation of coarse MnS to ferrite formed at grain boundaries during continuous casting, and cast cracking can be reduced.

In addition to the basic components described above, the chemical composition in the present disclosure may optionally further contain: one or more selected from the group consisting of B: 0.0100% or less, Cu: 0.3% or less, and Ni: 0.3% or less; one or more selected from the group consisting of W: 0.3% or more, Co: 0.3% or less, Hf: 0.2% or less, and Zr: 0.2% or less; or one or more selected from the group consisting of Pb: 0.2% or less, Bi: 0.2% or less, Zn: 0.2% or less, and Sn: 0.2% or less. The reasons for the addition of each element will be described below.

B: 0.0100% or Less

B has an effect of improving hardenability and promoting the formation of bainite microstructure. Thus, B is preferably added in an amount of 0.0003% or more. If the B content is exceeds 0.0100%, however, B precipitates as BN, the hardenability improving effect is saturated, and the component cost rises. Therefore, when added, the B content is set to 0.0100% or less. The B content is preferably 0.0005% or more and 0.0080% or less.

Cu: 0.3% or Less

Cu is a useful element for forming an intermetallic compound with Fe, Ni, or the like during nitrocarburizing treatment and increasing the strength of the nitrocarburized material by precipitation hardening, and is also effective for formation of bainite phase. When the Cu content exceeds 0.3%, hot workability decreases. Therefore, the Cu content is set to 0.3% or less. The Cu content is preferably in a range of 0.05% to 0.25%.

Ni: 0.3% or Less

Ni has an effect of increasing hardenability and suppressing low-temperature brittleness. A Ni content exceeding 0.3% not only cause a rise in hardness and adversely affect machinability by cutting, but also is disadvantageous in terms of cost. Therefore, the Ni content is set to 0.3% or less. The Ni content is preferably in a range of 0.05% to 0.25%.

W: 0.3% or Less, Co: 0.3% or Less, Hf: 0.2% or Less, Zr: 0.2% or Less

W, Co, Hf, and Zr are effective elements for improving the strength of the steel, and are each preferably added in an amount of 0.01% or more. However, adding W and Co beyond 0.3% and Hf and Zr beyond 0.2% decreases the toughness. Therefore, the upper limit is 0.3% for W and Co and 0.2% for Hf and Zr. Preferably, the content is W: 0.01% to 0.25%, Co: 0.01% to 0.25%, Hf: 0.01% to 0.15%, and Zr: 0.01% to 0.15%.

Pb: 0.2% or Less, Bi: 0.2% or Less, Zn: 0.2% or Less, Sn: 0.2% or Less

Pb, Bi, Zn, and Sn are effective elements for improving the machinability by cutting of the steel, and each can preferably be added in an amount of 0.02% or more. However, addition beyond 0.2% decreases strength and toughness. Therefore, the upper limit for each added element is 0.2%.

It suffices for the chemical composition of the steel to contain the above-described elements and the balance of Fe and incidental impurities, yet the chemical composition preferably consists of the above-described elements and the balance of Fe and incidental impurities.

Next, the steel microstructure of the steel for nitrocarburizing according to the disclosure will be described.

[Bainite Phase: More than 50% in Area Ratio]

In the present disclosure, it is vital that the steel microstructure contains bainite phase in an area ratio of more than 50% with respect to a whole volume of the steel microstructure.

The present disclosure intends to improve the fatigue strength after nitrocarburizing treatment by dispersing and precipitating V and Nb during nitrocarburizing treatment to increase the hardness of the nitride layer and the core part. In other words, if V and Nb precipitates are present in large amounts prior to nitrocarburizing treatment, this is disadvantageous from the viewpoint of machinability by cutting at the time of cutting work that is normally performed before nitrocarburizing. Further, in the bainite transformation process, V and Nb precipitates are less easily formed in the matrix phase as compared to the ferrite-pearlite transformation process. Therefore, the steel microstructure of the steel for nitrocarburizing according to the disclosure, i.e., the steel microstructure before nitrocarburizing treatment is mainly composed of bainite phase. Specifically, the area ratio of bainite phase is set to more than 50%, preferably more than 60%, and more preferably more than 80%, and may be 100%, with respect to the whole volume of the steel microstructure.

Possible microstructures other than the bainite phase include ferrite phase and pearlite phase, yet it is understood that such microstructures are preferably as less as possible.

Here, the phase area ratio is determined by polishing, and then etching with nital, the cross sections parallel to the rolling direction (L-sections) of test pieces sampled from the obtained steels for nitrocarburizing, and then observing the microstructures of the cross sections under an optical microscope or a scanning electron microscope (SEM) (microstructure observation under an optical microscope at 200 times magnification) to identify the phase type.

[Precipitates Containing V and Nb Dispersed in the Bainite Phase]

In the nitrocarburized component according to the disclosure, the steel for nitrocarburizing disclosed herein is preferably subjected to nitrocarburizing treatment so that precipitates containing V and Nb are dispersed in the bainite phase. The reason is that by causing precipitates containing V and Nb to be dispersed in the microstructure at the core part other than the nitrocarburized portion at the surface layer part, hardness increases and the fatigue strength after nitrocarburizing treatment is significantly improved.

The term "core part" used herein refers to a region excluding the surface compound layer and the hardened layer formed as a result of nitrocarburizing. However, it is preferable to cause precipitates containing V and Nb to disperse throughout the bainite phase, rather than only in the core part.

Further, precipitates containing V and Nb in the bainite phase preferably have a mean particle size of less than 10 nm, and the number of such precipitates to be dispersed is preferably at least 500 per unit area (1 $\mu m^2$) in order for the precipitates to contribute to strengthening by precipitation after nitrocarburizing treatment. The measurement limit for the diameter of precipitates is around 1 nm.

It is noted here that a component obtained by nitrocarburizing treatment has a nitrocarburized layer on the surface layer. In such component, a surface layer part (a part other than the core part) has a chemical composition that has higher carbon and nitrogen contents than those in the core part.

Next, methods of producing the steel for nitrocarburizing and the nitrocarburized component according to the disclosure will be described.

The FIGURE illustrates a typical process for producing a nitrocarburized component using a steel bar as the steel for nitrocarburizing disclosed herein.

In the FIGURE, S1 is steel bar production step, where a steel bar is used as the material, S2 is steel bar transportation step, and S3 is product (nitrocarburized component) finish step.

Firstly, in the steel bar production step (S1), a cast steel is hot rolled into a semi-finished product and hot rolled into a steel bar. The steel bar then goes through quality inspection before it is shipped.

Then, after being transported (S2), in the product (nitrocarburized component) finish step (S3), the steel bar is cut into a predetermined dimension, subjected to hot forging or cold forging, formed into a desired shape (such as the shape of a gear or a shaft component) by cutting work such as drill boring or lathe turning as necessary, and then subjected to nitrocarburizing treatment to obtain a product.

Alternatively, the hot rolled material may be directly subjected to cutting work such as lathe turning or drill boring to form a desired shape before subjection to nitrocarburizing treatment to obtain a product. In the case of hot forging, hot forging may be followed by cold straightening. In addition, the final product may be subjected to coating treatment such as painting or plating.

According to the method of producing the steel for nitrocarburizing disclosed herein, at the time of hot working right before nitrocarburizing treatment, it is possible to obtain a microstructure composed mainly of bainite phase as mentioned above and to suppress the formation of V and Nb precipitates by setting a specific heating temperature and a specific working temperature for hot working.

The phrase "hot working right before nitrocarburizing treatment" refers to either hot rolling or hot forging. However, hot forging may be performed after hot rolling. Of course, hot rolling may be followed by cold forging.

In the case of the hot working right before nitrocarburizing being hot rolling, in other words, if hot forging is not performed after hot rolling, the hot rolling needs to satisfy a set of conditions given below.

[Rolling Heating Temperature: 950° C. or Higher]

In the hot rolling, to prevent coarse carbonitrides from forming on the material being rolled and lowering fatigue strength, carbides remaining undissolved after dissolution are caused to dissolve and form a solute. If the rolling heating temperature is below 950° C., it is difficult for the carbides remaining undissolved after dissolution to dissolve and form a solute. Therefore, the rolling heating temperature is set to 950° C. or higher, and preferably 960° C. to 1250° C.

[Rolling Finishing Temperature: 800° C. or Higher]

When the rolling finishing temperature is below 800° C., a ferrite phase forms, which is disadvantageous in obtaining a microstructure that contains bainite phase in an area ratio of more than 50% with respect to the whole volume of the microstructure before nitrocarburizing treatment. The rolling load also increases. Therefore, the rolling finishing temperature is set to 800° C. or higher. Regarding the upper limit, when the rolling finishing temperature exceeds 1100° C., crystal grains coarsen, causing degradation in surface characteristics at the time of cutting work after the hot rolling, cold forgeability, and the like. Therefore, the rolling finishing temperature is preferably up to 1100° C.

[Cooling Rate after Rolling at Least in a Temperature Range of 700° C. to 550° C.: Higher than 0.4° C./s]

When the cooling rate after rolling at least in a temperature range of 700° C. to 550° C. is 0.4° C./s or lower, fine precipitates are formed and hardened before molding of components, resulting in increased cutting resistance during cutting work, and the tool life decreases. Therefore, at least in a temperature range of 700° C. to 550° C., which is the temperature range in which fine precipitates form, the cooling rate after rolling is set above the critical cooling rate of 0.4° C./s at which fine precipitates are obtained. Regarding the upper limit, if it exceeds 200° C./s, a hard martensite phase forms and machinability is greatly reduced. Therefore, the cooling rate after rolling in this temperature range is preferably up to 200° C./s.

In addition, in the case of the hot working right before nitrocarburizing treatment being hot forging, in other words, if hot forging is performed either alone or after hot rolling, the hot forging needs to satisfy a set of conditions given below. When hot rolling is performed before the hot forging, the hot rolling does not necessarily have to satisfy the above-described conditions as long as the below-described conditions are satisfied by the hot forming.

[Forging Heating Temperature: 950° C. or Higher]

In the hot forging, in order to form bainite phase in an area ratio of more than 50% with respect to the whole volume of the microstructure, and to suppress the formation of fine precipitates from the perspective of cold straightening and machinability by cutting after the hot forging, the heating temperature during the hot forging is set to 950° C. or higher. The heating temperature is preferably from 960° C. to 1250° C.

[Forging Finishing Temperature: 800° C. or Higher]

When the forging finishing temperature is below 800° C., a ferrite phase forms, which is disadvantageous in obtaining a microstructure that contains bainite phase in an area ratio of more than 50% with respect to the whole volume of the microstructure before nitrocarburizing treatment. The forging load also increases. Therefore, the forging finishing temperature is set to 800° C. or higher. Regarding the upper limit, when the forging finishing temperature exceeds 1100° C., crystal grains coarsen, causing degradation in surface characteristics at the time of cutting work after the hot forging. Therefore, the forging finishing temperature is preferably up to 1100° C.

[Cooling Rate after Forging at Least in a Temperature Range of 700° C. to 550° C.: Higher than 0.4° C./s]

When the cooling rate at least in a temperature range of 700° C. to 550° C. after forging is 0.4° C./s or lower, fine precipitates are formed and hardened before molding of components, resulting in increased cutting resistance during cutting work, and the tool life decreases. Therefore, at least in a temperature range of 700° C. to 550° C., which is the temperature range in which fine precipitates form, the cooling rate after forging is set above the critical cooling rate of 0.4° C./s at which fine precipitates are obtained. With respect to the upper limit, if it exceeds 200° C./s, a hard martensite phase forms and machinability is greatly reduced. Therefore, the cooling rate after forging in this temperature range is preferably up to 200° C./s.

Then, the materials thus rolled or forged may be subjected to cutting work and the like to have the shape of a component, and subsequently to nitrocarburizing treatment under a set of conditions below.

[Nitrocarburizing Treatment Conditions]

To form fine precipitates, nitrocarburizing treatment is preferably performed at a nitrocarburizing temperature in a range of 550° C. to 700° C. for a duration of 10 minutes or more. The reason why the nitrocarburizing temperature is set from 550° C. to 700° C. is that if the nitrocarburizing temperature is below 550° C., a sufficient amount of precipitates cannot be obtained, while if the nitrocarburizing temperature is above 700° C., it reaches the austenite region and makes and nitrocarburizing difficult to perform. The nitrocarburizing temperature is more preferably in a range of 550° C. to 630° C.

Since N and C are introduced and diffused at the same time in nitrocarburizing treatment, nitrocarburizing treatment may be performed in a mixed atmosphere of nitriding gas such as $NH_3$ or $N_2$ and carburizing gas such as $CO_2$ or CO, for example in an atmosphere of $NH_3$: $N_2$: $CO_2$=50:45:5.

EXAMPLES

Examples of the present disclosure will be specifically described below.

Steels (ID 1 to ID 51) having the compositions presented in Tables 1 and 2 were made into cast steels, each being 8000 mm long and having a cross section of 300 mm×400 mm, using a continuous casting machine. At that time, each steel was checked for cracks on the surface. Specifically, surface observation was performed in the longitudinal direction of each cast steel, and the presence or absence of cracks having a length of 10 mm or more was assessed. The number of cracks formed on the surface of the cast steel was counted per 1 $m^2$ of each cast steel, and based on the assessment criteria, A: no crack, B: 1-4 cracks/$m^2$, and C: 5 or more cracks/$m^2$, cases A and B were scored as passed.

TABLE 1

| Steel ID | C | Si | Mn | P | S | Cr | Mo | V | Nb | Al | Ti | N | Sb | Others | Formula 1 *) | Category |
|---|---|---|---|---|---|---|---|---|---|---|---|---|---|---|---|---|
| 1 | 0.043 | 0.05 | 1.75 | 0.014 | 0.015 | 1.15 | 0.070 | 0.08 | 0.063 | 0.035 | 0.013 | 0.0090 | 0.0005 | — | 4.10 | Example |
| 2 | 0.131 | 0.11 | 1.45 | 0.012 | 0.019 | 1.25 | 0.006 | 0.14 | 0.074 | 0.031 | 0.015 | 0.0044 | 0.0006 | — | 6.82 | Example |
| 3 | 0.179 | 0.25 | 2.42 | 0.012 | 0.017 | 1.32 | 0.105 | 0.12 | 0.051 | 0.028 | 0.009 | 0.0053 | 0.0007 | — | 11.72 | Example |
| 4 | 0.065 | 0.35 | 1.65 | 0.015 | 0.015 | 0.35 | 0.123 | 0.09 | 0.248 | 0.123 | 0.016 | 0.0048 | 0.0007 | — | 2.43 | Example |
| 5 | 0.045 | 0.65 | 1.75 | 0.010 | 0.016 | 1.26 | 0.051 | 0.12 | 0.176 | 0.350 | 0.009 | 0.0055 | 0.0012 | — | 4.76 | Example |
| 6 | 0.069 | 0.06 | 1.76 | 0.012 | 0.015 | 2.35 | 0.250 | 0.20 | 0.083 | 0.250 | 0.024 | 0.0053 | 0.0018 | — | 1.69 | Example |
| 7 | 0.053 | 0.07 | 1.55 | 0.008 | 0.016 | 1.35 | 0.256 | 0.18 | 0.034 | 0.265 | 0.021 | 0.0045 | 0.0009 | — | 1.88 | Example |
| 8 | 0.078 | 0.06 | 1.76 | 0.012 | 0.015 | 0.85 | 0.124 | 0.20 | 0.084 | 0.250 | 0.006 | 0.0123 | 0.0052 | — | 10.78 | Example |
| 9 | 0.054 | 0.07 | 1.64 | 0.008 | 0.016 | 1.65 | 0.090 | 0.34 | 0.199 | 0.265 | 0.013 | 0.0045 | 0.0185 | — | 3.03 | Example |
| 10 | 0.092 | 0.86 | 1.82 | 0.010 | 0.023 | 2.78 | 0.183 | 0.35 | 0.203 | 0.025 | 0.015 | 0.0056 | 0.0056 | — | 3.58 | Example |
| 11 | 0.034 | 0.05 | 1.77 | 0.012 | 0.017 | 1.74 | 0.084 | 0.04 | 0.124 | 0.010 | 0.011 | 0.0046 | 0.0098 | — | 3.75 | Example |
| 12 | 0.045 | 0.06 | 1.69 | 0.008 | 0.015 | 1.26 | 0.126 | 0.18 | 0.004 | 0.350 | 0.018 | 0.0036 | 0.0008 | B: 0.0005 | 1.94 | Example |

TABLE 1-continued

| Steel ID | C | Si | Mn | P | S | Cr | Mo | V | Nb | Al | Ti | N | Sb | Others | Formula 1 *) | Category |
|---|---|---|---|---|---|---|---|---|---|---|---|---|---|---|---|---|
| 13 | 0.063 | 0.12 | 2.26 | 0.015 | 0.016 | 1.34 | 0.254 | 0.13 | 0.148 | 0.550 | 0.022 | 0.0192 | 0.0010 | Cu: 0.1 | 4.08 | Example |
| 14 | 0.180 | 0.31 | 1.69 | 0.018 | 0.033 | 1.13 | 0.180 | 0.15 | 0.039 | 1.420 | 0.006 | 0.0054 | 0.0006 | Cu: 0.1, Ni: 0.15 | 25.76 | Example |
| 15 | 0.271 | 0.09 | 1.65 | 0.014 | 0.024 | 1.25 | 0.142 | 0.14 | 0.069 | 0.045 | 0.013 | 0.0065 | 0.0012 | — | 10.68 | Comparative Example |
| 16 | 0.084 | 1.26 | 1.65 | 0.012 | 0.024 | 1.16 | 0.111 | 0.16 | 0.078 | 0.035 | 0.011 | 0.0073 | 0.0053 | — | 5.55 | Comparative Example |
| 17 | 0.149 | 0.25 | 1.02 | 0.013 | 0.019 | 0.98 | 0.074 | 0.15 | 0.101 | 0.980 | 0.012 | 0.0047 | 0.0008 | — | 8.78 | Comparative Example |
| 18 | 0.129 | 0.09 | 3.24 | 0.018 | 0.025 | 1.46 | 0.068 | 0.21 | 0.049 | 0.135 | 0.018 | 0.0052 | 0.0009 | — | 7.14 | Comparative Example |
| 19 | 0.119 | 0.13 | 1.61 | 0.028 | 0.018 | 1.65 | 0.079 | 0.13 | 0.064 | 0.088 | 0.015 | 0.0063 | 0.0012 | — | 7.92 | Comparative Example |
| 20 | 0.051 | 0.13 | 2.13 | 0.018 | 0.075 | 1.34 | 0.231 | 0.25 | 0.063 | 0.153 | 0.011 | 0.0124 | 0.0013 | — | 14.09 | Comparative Example |
| 21 | 0.162 | 0.13 | 1.61 | 0.018 | 0.022 | 0.25 | 0.094 | 0.10 | 0.057 | 0.325 | 0.015 | 0.0032 | 0.0006 | — | 6.59 | Comparative Example |
| 22 | 0.090 | 0.13 | 1.61 | 0.018 | 0.022 | 3.15 | 0.118 | 0.11 | 0.054 | 0.325 | 0.015 | 0.0032 | 0.0012 | — | 2.93 | Comparative Example |
| 23 | 0.152 | 0.05 | 1.64 | 0.016 | 0.015 | 1.46 | 0.004 | 0.12 | 0.075 | 0.053 | 0.012 | 0.0056 | 0.0010 | — | 8.55 | Comparative Example |
| 24 | 0.112 | 0.22 | 1.73 | 0.014 | 0.034 | 2.01 | 0.096 | 0.01 | 0.052 | 0.024 | 0.006 | 0.0152 | 0.0009 | — | 43.06 | Comparative Example |
| 25 | 0.179 | 0.31 | 1.48 | 0.011 | 0.008 | 2.25 | 0.132 | 0.55 | 0.069 | 0.024 | 0.019 | 0.0065 | 0.0007 | — | 4.78 | Comparative Example |
| 26 | 0.169 | 0.06 | 1.66 | 0.015 | 0.026 | 1.48 | 0.062 | 0.14 | 0.002 | 0.824 | 0.015 | 0.0088 | 0.0014 | — | 11.23 | Comparative Example |
| 27 | 0.132 | 0.06 | 1.66 | 0.008 | 0.015 | 1.96 | 0.059 | 0.06 | 0.281 | 0.065 | 0.013 | 0.0051 | 0.0011 | — | 7.50 | Comparative Example |
| 28 | 0.151 | 0.06 | 1.66 | 0.012 | 0.026 | 1.34 | 0.057 | 0.13 | 0.054 | 0.004 | 0.011 | 0.0088 | 0.0009 | — | 15.32 | Comparative Example |
| 29 | 0.088 | 0.06 | 1.66 | 0.015 | 0.026 | 1.22 | 0.063 | 0.09 | 0.046 | 2.340 | 0.014 | 0.0103 | 0.0015 | — | 5.31 | Comparative Example |
| 30 | 0.118 | 0.13 | 1.92 | 0.016 | 0.028 | 1.16 | 0.164 | 0.14 | 0.088 | 0.030 | 0.005 | 0.0059 | 0.0008 | — | 28.94 | Comparative Example |
| 31 | 0.142 | 0.26 | 1.95 | 0.023 | 0.022 | 1.39 | 0.212 | 0.15 | 0.076 | 0.025 | 0.032 | 0.0123 | 0.0011 | — | 6.02 | Comparative Example |
| 32 | 0.083 | 0.02 | 0.95 | 0.011 | 0.025 | 1.45 | 0.149 | 0.012 | 0.012 | 0.018 | 0.008 | 0.0252 | 0.0010 | — | 15.49 | Comparative Example |
| 33 | 0.050 | 0.03 | 1.46 | 0.010 | 0.016 | 1.34 | 0.101 | 0.15 | 0.163 | 0.350 | 0.011 | 0.0123 | 0.0002 | — | 6.02 | Comparative Example |
| 34 | 0.206 | 0.33 | 0.81 | 0.014 | 0.021 | 1.15 | 0.001 | 0.005 | 0.001 | 0.027 | 0.001 | 0.0130 | — | — | — | Conventional Example |

*) Formula 1 [C: 0.01% or more and 0.10% or less] (S/32)/(Ti/48) + (N/14)/(Ti/48) = 0 to 13.0
[C: more than 0.10% and less than 0.20%] 2(S/32)/(Ti/48) + 3(N/14)/(Ti/48) = 0 to 35.0

TABLE 2

(mass %)

| Steel ID | C | Si | Mn | P | S | Cr | Mo | V | Nb | Al | Ti | N | Sb | Others | Formula 1 *) | Category |
|---|---|---|---|---|---|---|---|---|---|---|---|---|---|---|---|---|
| 35 | 0.055 | 0.03 | 3.00 | 0.008 | 0.06 | 1.28 | 0.072 | 0.12 | 0.065 | 0.023 | 0.012 | 0.0096 | 0.0056 | — | 10.2 | Example |
| 36 | 0.043 | 0.02 | 1.85 | 0.012 | 0.018 | 1.25 | 0.050 | 0.10 | 0.049 | 0.025 | 0.006 | 0.0102 | 0.0040 | W: 0.3 | 10.3 | Example |
| 37 | 0.145 | 0.05 | 1.51 | 0.010 | 0.020 | 2.51 | 0.103 | 0.15 | 0.190 | 0.031 | 0.012 | 0.0088 | 0.0060 | Co: 0.3 | 12.5 | Example |
| 38 | 0.102 | 0.20 | 1.98 | 0.015 | 0.017 | 1.85 | 0.123 | 0.18 | 0.156 | 0.028 | 0.013 | 0.0065 | 0.0008 | Hf: 0.2, Zr: 0.2 | 9.1 | Example |
| 39 | 0.088 | 0.03 | 1.86 | 0.013 | 0.015 | 0.68 | 0.089 | 0.12 | 0.210 | 1.230 | 0.023 | 0.0152 | 0.0070 | Pb: 0.1 | 3.2 | Example |
| 40 | 0.124 | 0.75 | 1.75 | 0.010 | 0.016 | 1.26 | 0.051 | 0.15 | 0.176 | 0.350 | 0.009 | 0.0055 | 0.0012 | Bi: 0.2 | 11.6 | Example |
| 41 | 0.045 | 0.02 | 1.54 | 0.012 | 0.013 | 2.21 | 0.062 | 0.45 | 0.123 | 0.045 | 0.015 | 0.0122 | 0.0040 | Zn: 0.2 | 4.1 | Example |
| 42 | 0.011 | 0.05 | 2.98 | 0.009 | 0.045 | 1.89 | 0.080 | 0.17 | 0.034 | 0.265 | 0.021 | 0.0045 | 0.0009 | Sn: 0.2 | 3.9 | Example |
| 43 | 0.088 | 0.02 | 1.82 | 0.012 | 0.024 | 1.11 | 0.200 | 0.03 | 0.036 | 0.050 | 0.006 | 0.0123 | 0.0012 | — | 13.0 | Example |
| 44 | 0.124 | 0.55 | 1.75 | 0.011 | 0.025 | 1.24 | 0.051 | 0.18 | 0.106 | 0.032 | 0.008 | 0.0199 | 0.0045 | — | 35.0 | Example |
| 45 | 0.180 | 0.05 | 1.55 | 0.023 | 0.018 | 1.35 | 0.410 | 0.15 | 0.086 | 0.032 | 0.015 | 0.0065 | 0.0085 | — | 8.1 | Comparative Example |
| 46 | 0.045 | 0.05 | 1.56 | 0.008 | 0.005 | 1.08 | 0.050 | 0.16 | 0.049 | 0.026 | 0.005 | 0.0030 | 0.0052 | — | 3.6 | Comparative Example |
| 47 | 0.155 | 0.03 | 1.78 | 0.010 | 0.006 | 1.62 | 0.075 | 0.12 | 0.150 | 0.032 | 0.005 | 0.0081 | 0.0034 | — | 20.3 | Comparative Example |
| 48 | 0.092 | 0.04 | 1.63 | 0.010 | 0.015 | 1.55 | 0.096 | 0.05 | 0.078 | 0.025 | 0.026 | 0.0200 | 0.0065 | — | 3.5 | Comparative Example |
| 49 | 0.045 | 0.03 | 1.98 | 0.018 | 0.031 | 1.63 | 0.060 | 0.03 | 0.045 | 0.050 | 0.008 | 0.0171 | 0.0005 | — | 13.1 | Comparative Example |

TABLE 2-continued (mass %)

| Steel ID | C | Si | Mn | P | S | Cr | Mo | V | Nb | Al | Ti | N | Sb | Others | Formula 1 *) | Category |
|---|---|---|---|---|---|---|---|---|---|---|---|---|---|---|---|---|
| 50 | 0.165 | 0.23 | 2.31 | 0.018 | 0.017 | 1.35 | 0.063 | 0.12 | 0.120 | 0.025 | 0.006 | 0.0155 | 0.0126 | — | 35.1 | Comparative Example |
| 51 | 0.123 | 0.12 | 1.54 | 0.012 | 0.013 | 2.35 | 0.062 | 0.36 | 0.111 | 0.046 | 0.015 | 0.0186 | 0.0004 | — | 15.4 | Comparative Example |

*) Formula 1 [C: 0.01% or more and 0.10% or less] (S/32)/(Ti/48) + (N/14)/(Ti/48) = 0 to 13.0
[C: more than 0.10% and less than 0.20%] 2(S/32)/(Ti/48) + 3(N/14)/(Ti/48) = 0 to 35.0

Each cast steel was subjected to soaking at 1200° C. for 30 minutes and hot rolled into a semi-finished product having a rectangular cross section with sides of 150 mm. Then, each cast steel was hot rolled under the conditions including heating temperature and rolling finishing temperature, as presented in Tables 3 and 4, to obtain a steel bar of 60 mm p. Then, each cast steel was cooled to room temperature with the cooling rate in the temperature range of 700° C. to 550° C. being adjusted as presented in Tables 3 and 4, and used as the material as hot rolled. It is noted here that Steel ID 34 is steel equivalent to JIS SCr 420.

Each material as hot rolled was further subjected to hot forging under the conditions presented in Tables 3 and 4 to obtain a steel bar of 30 mm φ, which in turn was cooled to room temperature with the cooling rate in the temperature range of 700° C. to 550° C. being adjusted as presented in Tables 3 and 4.

For the hot forged materials thus obtained, some of which were as hot rolled, the machinability was evaluated by an outer periphery turning test. As test pieces, either the hot forged materials or the materials as hot rolled in a situation in which hot forging was not performed were cut to a length of 200 mm. As the cutting tool, CSBNR 2020 was used as the folder and SNGN 120408 UTi20 high-speed tool steel was used for the tip (CSBNR 2020 and SNGN 120408 UTi20 are both manufactured by Mitsubishi Materials Corporation). The conditions of the outer circumferential turning test were as follows: cut depth 1.0 mm, feed rate 0.25 mm/rev, cutting speed 200 m/min, and no lubricant. For an evaluation item, the tool life was defined as the time until the tool wear (flank wear) reached 0.2 mm.

In addition, microstructure observation and hardness measurement were performed on the hot forged materials or the materials as hot rolled in a situation in which hot forging was not performed. In the microstructure observation, the type of phases was identified and the area ratio of each identified phase was determined with the above-described method.

In the hardness measurement, hardness HV was determined by averaging the results of measuring hardness at five locations, each being one-fourth the diameter from the surface of the test piece (which is hereinafter considered as the core part) with a test load of 2.94 N (300 gf) using a Vickers hardness meter in accordance with JIS Z 2244.

Regarding Steel Nos. 1 to 33, after subjection to the above-described hot forging, the test pieces were further subjected to nitrocarburizing treatment. Steel ID 1 includes cases where hot forging was not performed, in which case nitrocarburizing treatment was performed after hot rolling. On the other hand, regarding the hot forged materials with Steel ID 34, carburizing treatment was performed for comparison.

Nitrocarburizing treatment was performed by heating the steel samples to a temperature range of 525° C. to 620° C. in an atmosphere of $NH_3$: $N_2$:$CO_2$=50:45:5 and retaining them for 3.5 hours.

On the other hand, carburizing treatment was performed by carburizing the test pieces at 930° C. for 3 hours, holding them at 850° C. for 40 minutes, oil quenching them, and further tempering them at 170° C. for 1 hour.

The materials thus obtained by being subjected to nitrocarburizing treatment and carburizing heat treatment were further subjected to microstructure observation, hardness measurement, and fatigue property evaluation.

In the microstructure observation, as it was before nitrocarburizing treatment, the type of phases was identified and the area ratio of each identified phase was determined with the above-described method.

In the hardness measurement, measurement was made of the surface hardness of each of the above-described heat-treated materials at a depth of 0.05 mm from the surface, and of the core hardness at the core part. In the surface hardness measurement and core hardness measurement, surface hardness HV and core hardness HV were determined by respectively averaging the results of measuring the hardness at the core part at six locations with a test load of 2.94 N (300 gf) using a Vickers hardness meter in accordance with JIS Z 2244. Measurement was further made of the depth of the hardened layer, which was defined as the depth from the surface at which HV of 520 is obtained.

Further, from the core parts of the nitrocarburized materials and the carburized materials, test pieces were prepared by twin-jet electropolishing for transmission electron microscope observation, and precipitates on the test pieces were observed under a transmission electron microscope with acceleration voltage of 200 V. Further, the compositions of the observed precipitates were determined with an energy-dispersive X-ray spectrometer (EDX).

For fatigue property evaluation, a roller pitching test was conducted, and fatigue strength after 107 cycles was determined. Fatigue test pieces were sampled from the materials as hot rolled or the hot forged materials as described above in parallel with their longitudinal direction. Each test piece had a parallel portion of 26 mmφ×28 mm long and a grip portion of 24 mmφ. Each test piece was then subjected to nitrocarburizing treatment. For those test pieces that were rated B or C regarding the presence or absence of cracks on the surface of the cast steel, test pieces were sampled from locations other than where cracks occurred. In each roller pitching test piece, 26 mm y rolling contact surface was left as nitrocarburized (without polishing). In the roller pitching test, the slip rate was −40%, automatic transmission oil (Mitsubishi ATF SP-III) was used as the lubricating oil, and the oil temperature was 80° C. As large rollers, carburized quenched products of SCM 420H with crowning R of 150 mm were used.

Tables 3 and 4 present the results of the above tests. Nos. 1-19 and 50-59 are our examples, Nos. 20-48 and 60-66 are comparative examples, and No. 49 is a conventional example in which a steel equivalent to JIS SCr420 was subjected to carburizing treatment.

As is clear from Tables 3 and 4, Examples 1-19 and 50-59 are all superior in fatigue strength as compared to Conventional Example 49 subjected to carburizing treatment. Examples 1-19 and 50-59 also exhibit better machinability by cutting before nitrocarburizing treatment than Conventional Example No. 49.

Furthermore, as a result of observing precipitates with a transmission electron microscope and investigating compositions of the precipitates with an energy dispersive X-ray spectroscope (EDX), it was confirmed that in the nitrocarburized materials of Examples 1-19 and 50-59, at least 500 per 1 $\mu m^2$ fine precipitates containing V and Nb and having a particle size of less than 10 nm were formed and dispersed in the bainite phase. From this result, it is considered that the nitrocarburizing materials according to the disclosure exhibited high fatigue strength due to the fine precipitates.

By contrast, for Comparative Example Nos. 20-48 in which the chemical composition or the obtained steel microstructure was outside the range of this disclosure, many cracks occurred during continuous casting or fatigue strength or machinability was inferior.

Specifically, for No. 20, since the heating temperature during hot rolling was low, precipitates were not dissolved sufficiently and the fatigue properties were inferior. Besides, due to a high proportion of F+P microstructure, the machinability by cutting after hot rolling was also low.

For No. 21, since the finishing temperature of hot rolling was too low, the bainite fraction of the microstructure was low and the machinability by cutting was inferior. In addition, since the proportion of F+P microstructure was high, fine precipitates were not formed after nitrocarburizing, and the fatigue properties were thus inferior.

For Nos. 22 and 23, since the cooling rate after hot forging was low, an appropriate amount of bainite phase was not obtained, and only a small amount of fine precipitates was formed through nitrocarburizing treatment, resulting in insufficient strengthening by precipitation and lower fatigue strength compared to our examples. The machinability by cutting was also low.

For No. 24, since the heating temperature of hot forging was low, precipitates were not dissolved sufficiently and the fatigue properties were inferior.

Besides, due to a high proportion of F+P microstructure, the machinability by cutting after hot rolling was also low.

For No. 25, since the finishing temperature of hot forging is too low, the bainite fraction of the microstructure is low and the machinability by cutting is inferior. In addition, since the proportion of F+P microstructure was high, fine precipitates were not formed after nitrocarburizing, and the fatigue properties were inferior.

For Nos. 26 and 27, since the cooling rate after hot forging was low, an appropriate amount of bainite phase was not obtained, and only a small amount of fine precipitates was formed through nitrocarburizing treatment, resulting in insufficient strengthening by precipitation and lower fatigue strength compared to our examples. The machinability by cutting was also low.

For No. 28, since the nitrocarburizing temperature was low, the depth of the hardened layer was small and the fatigue strength was inferior.

For No. 29, since the nitrocarburizing treatment temperature was high, nitrocarburizing was not sufficient, nor was precipitation of fine precipitates adequate. Thus, the fatigue strength was low.

For No. 30, since the C content exceeded the appropriate range, the hot forged material increased in hardness before subjection to nitrocarburizing treatment, and decreased in machinability by cutting.

For No. 31, since the Si content exceeded the appropriate range, the hot forged material increased in hardness before subjection to nitrocarburizing treatment, and decreased in machinability by cutting.

Regarding example No. 32, since the Mn content was below the appropriate range, ferrite and pearlite phases were dominant in the steel microstructure of the hot forged material before subjection to nitrocarburizing treatment. Thus, V and Nb precipitates were formed in the microstructure, the hardness before nitrocarburizing treatment increased, and the machinability by cutting decreased.

For No. 33, since the Mn content exceeded the appropriate range, many cracks occurred during continuous casting. In addition, a martensite phase was formed before nitrocarburizing treatment, and the machinability by cutting was low.

For No. 34, since the P content exceeded the appropriate range, many cracks occurred during continuous casting. The fatigue strength was also low.

For No. 35, since the S content exceeded the appropriate range and the value on the left side of the above Formula (1) was outside the range of the present disclosure, many cracks occurred during continuous casting.

For No. 36, since the Cr content was below the appropriate range, ferrite and pearlite phases were dominant in the steel microstructure of the hot forged material before subjection to nitrocarburizing treatment. Accordingly, coarse V and Nb precipitates were formed in the microstructure, the hardness before nitrocarburizing treatment increased, and the fatigue strength decreased.

For No. 37, since the Cr content exceeded the appropriate range, many cracks occurred during continuous casting. In addition, since the hardness after hot forging was high, the machinability by cutting was inferior.

For No. 38, since the Mo content was below the appropriate range, the hardenability decreased and the formation of the bainite phase is insufficient. This resulted in a small amount of fine precipitates formed after nitrocarburizing treatment and insufficient core hardness. Accordingly, the fatigue strength was low as compared with Conventional Example No. 49.

For No. 39, since the V content was below the appropriate range, only a small amount of fine precipitates was formed through nitrocarburizing treatment, and sufficient core hardness was not obtained. Accordingly, the fatigue strength was low as compared with Conventional Example No. 49.

For No. 40, since the V content exceeded the appropriate range, many cracks occurred during continuous casting.

Regarding example No. 41, since the Nb content was below the appropriate range, only a small amount of fine precipitates was formed through nitrocarburizing treatment, and sufficient core hardness was not obtained.

Accordingly, the fatigue strength was low as compared with Conventional Example No. 49.

For No. 42, the Nb content exceeded the appropriate range, and many cracks occurred during continuous casting.

For No. 43, since the Al content was below the appropriate range, neither sufficient surface strength nor an effective hardened case depth were obtained after nitrocarburizing treatment, and the fatigue strength was lower than that of Conventional Example No. 49.

For No. 44, since the Al content exceeded the appropriate range, many cracks occurred during continuous casting.

For No. 45, the Ti content did not satisfy the appropriate range, many cracks occurred during continuous casting.

For No. 46, since the Ti content exceeded the appropriate range, the fatigue strength was low.

For No. 47, since the N content exceeded the appropriate range, many cracks occurred during continuous casting.

For No. 48, since the Sb content exceeded the appropriate range, many cracks occurred during continuous casting.

For No. 60, since the Mo content exceeded the appropriate range, many cracks occurred during continuous casting.

For Nos. 61 and 62, since the Ti content was below the appropriate range, many cracks occurred during continuous casting.

For No. 63, since the Ti content exceeded the appropriate range, the fatigue strength was low.

For No. 64, since the value on the left side of the above Formula (1) exceeded 13.0, many cracks occurred during continuous casting.

For No. 65, since the value on the left side of the above Formula (1) exceeded 35.0, many cracks occurred during continuous casting.

In No. 66, since the Sb content was below the appropriate range, many cracks occurred during continuous casting.

TABLE 3

| No. | Steel ID | Cracks on the surface of the semi-finished product*4 | Hot rolling conditions: Heating temp. for hot rolling (° C.) | Hot rolling: Hot rolling finishing temp. (° C.) | Hot rolling: Cooling rate after hot rolling (° C./s) | Hot forging conditions: Heating temp. for hot forging (° C.) | Hot forging: Hot forging finishing temp. (° C.) | Hot forging: Cooling rate after hot forging (° C./s) | Steel properties (before nitrocarburizing treatment): Core hardness HV | Steel properties (before nitrocarburizing treatment): Steel microstructure |
|---|---|---|---|---|---|---|---|---|---|---|
| 1 | 1 | A | 1150 | 970 | 0.8 | 1200 | 1100 | 0.8 | 253 | B dominant |
| 2 | 2 | A | 1150 | 970 | 0.7 | 1200 | 1100 | 0.8 | 301 | B dominant |
| 3 | 3 | A | 1150 | 970 | 0.8 | 1200 | 1100 | 0.8 | 317 | B dominant |
| 4 | 4 | A | 1150 | 970 | 0.7 | 1200 | 1100 | 0.8 | 282 | B dominant |
| 5 | 5 | A | 1150 | 970 | 0.8 | 1200 | 1100 | 0.7 | 280 | B dominant |
| 6 | 6 | B | 1150 | 970 | 0.8 | 1200 | 1100 | 0.8 | 285 | B dominant |
| 7 | 7 | B | 1150 | 970 | 0.6 | 1200 | 1100 | 0.8 | 279 | B dominant |
| 8 | 8 | A | 1150 | 970 | 0.8 | 1200 | 1100 | 0.8 | 284 | B dominant |
| 9 | 9 | A | 1150 | 970 | 0.8 | 1200 | 1100 | 0.5 | 252 | B dominant |
| 10 | 10 | A | 1150 | 970 | 0.5 | 1200 | 1100 | 0.8 | 291 | B dominant |
| 11 | 11 | A | 1050 | 900 | 0.8 | 1200 | 1100 | 0.6 | 281 | B dominant |
| 12 | 12 | A | 1150 | 970 | 0.8 | 1200 | 1100 | 0.8 | 277 | B dominant |
| 13 | 13 | B | 1050 | 910 | 0.8 | 1200 | 1100 | 0.5 | 290 | B dominant |
| 14 | 14 | A | 1080 | 920 | 0.8 | 1200 | 1100 | 0.8 | 275 | B dominant |
| 15 | 1 | A | 1150 | 970 | 0.8 | 960 | 840 | 0.8 | 249 | B dominant |
| 16 | 1 | A | 1150 | 970 | 0.8 | 1250 | 1050 | 0.8 | 256 | B dominant |
| 17 | 1 | A | 1150 | 970 | 0.8 | — | — | — | 252 | B dominant |
| 18 | 1 | A | 960 | 810 | 0.8 | — | — | — | 239 | B dominant |
| 19 | 1 | A | 1250 | 1050 | 0.8 | — | — | — | 233 | B dominant |
| 20 | 1 | A | 930 | 815 | 0.8 | — | — | — | 183 | F + P + B |
| 21 | 1 | A | 1150 | 750 | 0.8 | — | — | — | 222 | F + P + B |
| 22 | 1 | A | 1150 | 970 | 0.3 | — | — | — | 210 | F + P + B |
| 23 | 1 | A | 1150 | 970 | 0.4 | — | — | — | 215 | F + P + B |
| 24 | 1 | A | 1150 | 970 | 0.8 | 900 | 1100 | 0.8 | 195 | F + P + B |
| 25 | 1 | A | 1150 | 970 | 0.8 | 1200 | 750 | 0.8 | 256 | F + P + B |

| No. | Steel properties (before nitrocarburizing treatment): Area ratio of bainite phase (%) | Steel properties (before nitrocarburizing treatment): Tool life (s) | Nitrocarburizing treatment temp. (° C.) | Steel properties (after nitrocarburizing treatment): Surface hardness HV | Steel properties (after nitrocarburizing treatment): Depth of hardened layer (mm) | Steel properties (after nitrocarburizing treatment): Core hardness HV | Steel properties (after nitrocarburizing treatment): Steel microstructure | Steel properties (after nitrocarburizing treatment): Area ratio of bainite phase (%) | Steel properties (after nitrocarburizing treatment): Fatigue strength (MPa) | Remarks |
|---|---|---|---|---|---|---|---|---|---|---|
| 1 | 92 | 630 | 575 | 816 | 0.17 | 263 | B dominant | 93 | 2550 | Example |
| 2 | 98 | 510 | 580 | 813 | 0.16 | 312 | B dominant | 98 | 2600 | Example |
| 3 | 97 | 471 | 600 | 826 | 0.20 | 326 | B dominant | 97 | 2650 | Example |
| 4 | 95 | 559 | 590 | 831 | 0.21 | 302 | B dominant | 92 | 2600 | Example |
| 5 | 96 | 563 | 595 | 823 | 0.20 | 298 | B dominant | 96 | 2650 | Example |
| 6 | 98 | 550 | 580 | 815 | 0.18 | 301 | B dominant | 97 | 2600 | Example |
| 7 | 94 | 564 | 575 | 819 | 0.19 | 304 | B dominant | 95 | 2650 | Example |
| 8 | 96 | 552 | 570 | 817 | 0.16 | 305 | B dominant | 94 | 2600 | Example |
| 9 | 55 | 632 | 570 | 820 | 0.15 | 256 | B dominant | 53 | 2550 | Example |
| 10 | 93 | 534 | 570 | 823 | 0.18 | 310 | B dominant | 95 | 2900 | Example |
| 11 | 60 | 561 | 570 | 843 | 0.20 | 299 | B dominant | 57 | 2550 | Example |
| 12 | 97 | 570 | 570 | 826 | 0.19 | 288 | B dominant | 99 | 2550 | Example |
| 13 | 96 | 538 | 570 | 821 | 0.17 | 306 | B dominant | 98 | 2600 | Example |
| 14 | 80 | 575 | 570 | 812 | 0.18 | 295 | B dominant | 78 | 2850 | Example |
| 15 | 88 | 640 | 570 | 823 | 0.23 | 260 | B dominant | 84 | 2750 | Example |
| 16 | 96 | 623 | 570 | 819 | 0.22 | 263 | B dominant | 93 | 2650 | Example |
| 17 | 96 | 632 | 560 | 825 | 0.23 | 269 | B dominant | 95 | 2500 | Example |
| 18 | 87 | 665 | 570 | 823 | 0.21 | 251 | B dominant | 84 | 2550 | Example |

TABLE 3-continued

| | | | | | | | | | | |
|---|---|---|---|---|---|---|---|---|---|---|
| 19 | 75 | 680 | 570 | 805 | 0.18 | 249 | B dominant | 74 | 2500 | Example |
| 20 | 42 | 405 | 570 | 786 | 0.19 | 223 | F + P + B | 40 | 1950 | Comparative Example |
| 21 | 24 | 309 | 570 | 789 | 0.18 | 205 | F + P + B | 22 | 2150 | Comparative Example |
| 22 | 38 | 186 | 570 | 796 | 0.18 | 208 | F + P + B | 35 | 2050 | Comparative Example |
| 23 | 45 | 213 | 570 | 803 | 0.19 | 216 | F + P + B | 42 | 2100 | Comparative Example |
| 24 | 45 | 299 | 570 | 650 | 0.14 | 278 | F + P + B | 40 | 2050 | Comparative Example |
| 25 | 24 | 126 | 570 | 512 | 0.26 | 401 | F + P + B | 22 | 2000 | Comparative Example |

| | | Cracks on the | Hot rolling conditions | | | Hot forging conditions | | | Steel properties (before nitrocarburizing treatment | |
|---|---|---|---|---|---|---|---|---|---|---|
| No. | Steel ID | surface of the semi-finished product*4 | Heating temp. for hot rolling (° C.) | Hot rolling finishing temp. (° C.) | Cooling rate after hot rolling (° C./s) | Heating temp. for hot forging (° C.) | Hot forging finishing temp. (° C.) | Cooling rate after hot forging (° C./s) | Core hardness HV | Steel microstructure |
| 26 | 1 | A | 1150 | 970 | 0.8 | 1200 | 1100 | 0.3 | 220 | F + P + B |
| 27 | 1 | A | 1150 | 970 | 0.8 | 1200 | 1100 | 0.4 | 231 | F + P + B |
| 28 | 1 | A | 1150 | 970 | 0.8 | 1200 | 1100 | 0.8 | 253 | B dominant |
| 29 | 1 | A | 1150 | 970 | 0.8 | 1200 | 1100 | 0.8 | 253 | B dominant |
| 30 | 15 | B | 1150 | 970 | 0.8 | 1200 | 1100 | 0.8 | 389 | B dominant |
| 31 | 16 | B | 1150 | 971 | 0.8 | 1200 | 1100 | 0.8 | 356 | B dominant |
| 32 | 17 | A | 1150 | 970 | 0.8 | 1200 | 1100 | 0.8 | 321 | F + P |
| 33 | 18 | C | 1150 | 970 | 0.8 | 1200 | 1100 | 0.8 | 363 | B dominant |
| 34 | 19 | C | 1150 | 970 | 0.8 | 1200 | 1100 | 0.8 | 298 | B dominant |
| 35 | 20 | C | 1150 | 970 | 0.8 | 1200 | 1100 | 0.8 | 281 | B dominant |
| 36 | 21 | A | 1150 | 970 | 0.8 | 1200 | 1100 | 0.8 | 285 | F + P + B |
| 37 | 22 | B | 1150 | 970 | 0.8 | 1200 | 1100 | 0.8 | 401 | M + B |
| 38 | 23 | A | 1150 | 970 | 0.8 | 1200 | 1100 | 0.8 | 202 | F + P + B |
| 39 | 24 | A | 1150 | 970 | 0.8 | 1200 | 1100 | 0.8 | 191 | B dominant |
| 40 | 25 | C | 1150 | 970 | 0.8 | 1200 | 1100 | 0.8 | 320 | B dominant |
| 41 | 26 | A | 1150 | 970 | 0.8 | 1200 | 1100 | 0.8 | 223 | B dominant |
| 42 | 27 | C | 1150 | 970 | 0.8 | 1200 | 1100 | 0.8 | 280 | B dominant |
| 43 | 28 | A | 1150 | 970 | 0.8 | 1200 | 1100 | 0.8 | 307 | B dominant |
| 44 | 29 | C | 1150 | 970 | 0.8 | 1200 | 1100 | 0.8 | 292 | B dominant |
| 45 | 30 | C | 1150 | 970 | 0.8 | 1200 | 1100 | 0.8 | 299 | B dominant |
| 46 | 31 | A | 1150 | 970 | 0.8 | 1200 | 1100 | 0.8 | 306 | B dominant |
| 47 | 32 | C | 1150 | 970 | 0.8 | 1200 | 1100 | 0.8 | 285 | B dominant |
| 48 | 33 | C | 1150 | 970 | 0.8 | 1200 | 1100 | 0.8 | 278 | B dominant |
| 49 | 34 | B | 1150 | 970 | 0.8 | 1200 | 1100 | 0.8 | 220 | F + P |

| | Steel properties (before nitrocarbuizing treatment) | | | Steel properties (after nitrocarbuizing treatment) | | | | | | |
|---|---|---|---|---|---|---|---|---|---|---|
| No. | Area ratio of bainite phase (%) | Tool life (s) | Nitrocarbuizing treatment temp. (° C.) | Surface hardness HV | Depth of hardened layer (mm) | Core hardness HV | Steel microstructure | Area ratio of bainite phase (%) | Fatigue strength (MPa) | Remarks |
| 26 | 41 | 133 | 570 | 788 | 0.22 | 202 | F + P + B | 36 | 2100 | Comparative Example |
| 27 | 48 | 136 | 570 | 801 | 0.19 | 215 | F + P + B | 42 | 1950 | Comparative Example |
| 28 | 92 | 630 | 400 | 602 | 0.05 | 222 | B dominant | 91 | 2050 | Comparative Example |
| 29 | 92 | 630 | 710 | 599 | 0.08 | 213 | B dominant | 89 | 2050 | Comparative Example |
| 30 | 95 | 126 | 570 | 812 | 0.26 | 401 | B dominant | 94 | 2400 | Comparative Example |
| 31 | 85 | 374 | 570 | 825 | 0.23 | 345 | B dominant | 84 | 2650 | Comparative Example |
| 32 | 32 | 133 | 570 | 788 | 0.18 | 371 | F + P | 32 | 2650 | Comparative Example |

TABLE 3-continued

| | | | | | | | | | | |
|---|---|---|---|---|---|---|---|---|---|---|
| 33 | 96 | 224 | 570 | 803 | 0.25 | 370 | B dominant | 94 | 2400 | Comparative Example |
| 34 | 96 | 517 | 570 | 805 | 0.19 | 316 | B dominant | 94 | 1900 | Comparative Example |
| 35 | 95 | 561 | 570 | 814 | 0.20 | 301 | B dominant | 96 | 2550 | Comparative Example |
| 36 | 23 | 169 | 570 | 794 | 0.10 | 262 | F + P + B | 19 | 2150 | Comparative Example |
| 37 | 56 | 122 | 570 | 825 | 0.29 | 398 | tempered M + B | 39 | 2650 | Comparative Example |
| 38 | 18 | 162 | 570 | 792 | 0.09 | 211 | F + P + B | 18 | 2000 | Comparative Example |
| 39 | 96 | 510 | 570 | 816 | 0.08 | 178 | B dominant | 94 | 2100 | Comparative Example |
| 40 | 97 | 312 | 570 | 810 | 0.18 | 326 | B dominant | 95 | 2050 | Comparative Example |
| 41 | 95 | 505 | 570 | 808 | 0.17 | 222 | B dominant | 97 | 2100 | Comparative Example |
| 42 | 96 | 493 | 570 | 810 | 0.18 | 295 | B dominant | 96 | 2050 | Comparative Example |
| 43 | 94 | 495 | 570 | 702 | 0.07 | 321 | B dominant | 95 | 1950 | Comparative Example |
| 44 | 87 | 533 | 570 | 845 | 0.29 | 324 | B dominant | 94 | 2650 | Comparative Example |
| 45 | 91 | 515 | 570 | 815 | 0.18 | 319 | B dominant | 93 | 2200 | Comparative Example |
| 46 | 94 | 498 | 570 | 804 | 0.14 | 275 | B dominant | 95 | 2050 | Comparative Example |
| 47 | 93 | 551 | 570 | 810 | 0.15 | 270 | B dominant | 94 | 2150 | Comparative Example |
| 48 | 90 | 568 | 570 | 816 | 0.17 | 272 | B dominant | 94 | 2300 | Comparative Example |
| 49 | 75 | 265 | —*3 | 730 | 1.02 | 344 | tempered M + B | 48 | 2400 | Conventional Example |

*1 Underlined values are outside of the range of the present disclosure.

*2 Microstructural symbols are the following phrases: F, ferrite, P: pearlite, B: bainite, M: martensite

*3Carbuizing treatment was performed.

*4Criteria for assessing cracks on the surface of the cast steel: A: no crack, B: 1-4 cracks/$m^2$, and C: 5 or more cracks/$m^2$.

TABLE 4

| | | Cracks | Hot rolling conditions | | | Hot forging conditions | | | Steel properties (before nitrocarburizing treatment) | |
|---|---|---|---|---|---|---|---|---|---|---|
| No. | Steel ID | on the surface of the semi-finished product*4 | Heating temp. for hot rolling (° C.) | Hot rolling finishing temp. (° C.) | Cooling rate after hot rolling (° C./s) | Heating temp. for hot forging (° C.) | Hot forging finishing temp. (° C.) | Cooling rate after hot forging (° C./s) | Core hardness HV | Steel microstructure |
| 50 | 35 | B | 1150 | 970 | 0.6 | 1200 | 1100 | 0.7 | 262 | B dominant |
| 51 | 36 | A | 1150 | 970 | 0.8 | 1200 | 1100 | 0.8 | 296 | B dominant |
| 52 | 37 | A | 1150 | 970 | 0.7 | 1200 | 1100 | 0.8 | 363 | B dominant |
| 53 | 38 | A | 1150 | 970 | 0.5 | 1200 | 1100 | 0.5 | 335 | B dominant |
| 54 | 39 | B | 1150 | 970 | 0.8 | 1200 | 1100 | 0.8 | 280 | B dominant |
| 55 | 40 | B | 1150 | 970 | 0.8 | 1200 | 1100 | 0.8 | 301 | B dominant |
| 56 | 41 | B | 1150 | 970 | 0.8 | 1200 | 1100 | 0.6 | 256 | B dominant |
| 57 | 42 | B | 1150 | 970 | 0.8 | 1200 | 1100 | 0.8 | 237 | B dominant |
| 58 | 43 | B | 1150 | 970 | 0.8 | 1200 | 1100 | 0.8 | 280 | B dominant |
| 59 | 44 | B | 1150 | 970 | 0.7 | 1200 | 1100 | 0.7 | 301 | B dominant |
| 60 | 45 | C | 1150 | 970 | 0.8 | 1200 | 1100 | 0.8 | 333 | B dominant |
| 61 | 46 | C | 1150 | 970 | 0.8 | 1200 | 1100 | 0.8 | 256 | B dominant |
| 62 | 47 | C | 1150 | 970 | 0.8 | 1200 | 1100 | 0.8 | 319 | B dominant |
| 63 | 48 | B | 1150 | 970 | 0.8 | 1200 | 1100 | 0.8 | 283 | B dominant |
| 64 | 49 | C | 1150 | 970 | 0.8 | 1200 | 1100 | 0.8 | 256 | B dominant |
| 65 | 50 | C | 1150 | 970 | 0.8 | 1200 | 1100 | 0.8 | 324 | B dominant |
| 66 | 51 | C | 1150 | 970 | 0.8 | 1200 | 1100 | 0.8 | 300 | B dominant |

TABLE 4-continued

| No. | Steel properties (before nitro-carburizing treatment) Area ratio of bainite phase (%) | Tool life (s) | Nitro-carburizing treatment temp. (° C.) | Steel properties (after nitrocarburizing treatment) Surface hardness HV | Depth of hardened layer (mm) | Core hardness HV | Steel microstructure | Area ratio of bainite phase (%) | Fatigue strength (MPa) | Remarks |
|---|---|---|---|---|---|---|---|---|---|---|
| 50 | 92 | 1003 | 570 | 820 | 0.16 | 302 | B dominant | 91 | 2550 | Example |
| 51 | 95 | 625 | 590 | 834 | 0.15 | 356 | B dominant | 99 | 2950 | Example |
| 52 | 100 | 483 | 595 | 815 | 0.21 | 370 | B dominant | 96 | 3000 | Example |
| 53 | 92 | 543 | 585 | 812 | 0.20 | 299 | B dominant | 90 | 2850 | Example |
| 54 | 96 | 1205 | 570 | 800 | 0.19 | 350 | B dominant | 95 | 2500 | Example |
| 55 | 98 | 1360 | 565 | 811 | 0.17 | 265 | B dominant | 98 | 2450 | Example |
| 56 | 97 | 1230 | 570 | 825 | 0.18 | 280 | B dominant | 96 | 2500 | Example |
| 57 | 95 | 750 | 570 | 821 | 0.20 | 257 | B dominant | 97 | 2550 | Example |
| 58 | 95 | 657 | 570 | 815 | 0.18 | 301 | B dominant | 95 | 2500 | Example |
| 59 | 94 | 614 | 600 | 810 | 0.19 | 230 | B dominant | 93 | 2550 | Example |
| 60 | 100 | 547 | 570 | 823 | 0.18 | 342 | B dominant | 99 | 2450 | Comparative Example |
| 61 | 94 | 709 | 570 | 805 | 0.17 | 272 | B dominant | 92 | 2400 | Comparative Example |
| 62 | 93 | 577 | 570 | 811 | 0.19 | 302 | B dominant | 91 | 2450 | Comparative Example |
| 63 | 95 | 652 | 570 | 822 | 0.16 | 274 | B dominant | 96 | 1950 | Comparative Example |
| 64 | 95 | 709 | 570 | 812 | 0.18 | 280 | B dominant | 95 | 2400 | Comparative Example |
| 65 | 96 | 565 | 570 | 816 | 0.16 | 341 | B dominant | 93 | 2450 | Comparative Example |
| 66 | 96 | 615 | 570 | 817 | 0.16 | 332 | B dominant | 94 | 2500 | Comparative Example |

*1 Underlined values are outside of the range of the present disclosure.
*2 Microstructural symbols are the following phases: F: ferrite, P: pearlite, B: bainite, M: martensite
*3 Carburizing treatment was performed.
*4Criteria for assessing cracks on the surface of the cast steel A: no crack, B: 1-4 cracks/$m^2$, and C: 5 or more cracks/$m^2$.

The invention claimed is:

1. A component comprising a core part and a surface layer, wherein the core part comprises a chemical composition that consists of, in mass %, C: 0.01% or more and less than 0.20%, Si: 1.0% or less, Mn: 1.5% or more and 3.0% or less, P: 0.02% or less, S: 0.06% or less, Cr: 0.30% or more and 3.0% or less, Mo: 0.005% or more and 0.40% or less, V: 0.02% or more and 0.5% or less, Nb: 0.003% or more and 0.20% or less, Al: 0.010% or more and 2.0% or less, Ti: more than 0.005% and less than 0.025%, N: 0.0200% or less, Sb: 0.0005% or more and 0.02% or less, and optionally one or more selected from the group consisting of B: 0.0100% or less, Cu: 0.3% or less, Ni: 0.3% or less, W: 0.3% or less, Co: 0.3% or less, Hf: 0.2% or less, Pb: 0.2% or less, Bi: 0.2% or less, Zn: 0.2% or less, and Sn: 0.2% or less, and the balance consisting of Fe and incidental impurities, with the chemical composition satisfying either one of following relations:

in a case where the C content is 0.01% or more and 0.10% or less, $(S/32)/(Ti/48)+(N/14)/(Ti/48)\leq 13.0$, wherein each of S, Ti and N represents respectively S content, Ti content and N content expressed as mass %, and in a case where the C content is more than 0.10% and less than 0.20%, $2(S/32)/(Ti/48)+3(N/14)/(Ti/48)\leq 35.0$, wherein each of S, Ti and N represents respectively S content, Ti content and N content expressed as mass %, the core part comprises a steel microstructure that contains bainite phase in an area ratio of more than 50%, and the surface layer comprises a chemical composition with high nitrogen and carbon contents relative to the chemical composition of the core part.

2. The component according to claim 1, wherein precipitates containing V and Nb are dispersed in the bainite phase.

3. The component according to claim 1, wherein the core part comprises a steel microstructure that contains bainite phase in an area ratio of more than 80%.

* * * * *